United States Patent [19]

Patrick et al.

[11] Patent Number: 4,948,438

[45] Date of Patent: Aug. 14, 1990

[54] INTERMOLECULAR COMPLEX EXPLOSIVES

[75] Inventors: Michael A. Patrick, Shalimar; Stephen A. Aubert, Niceville, both of Fla.

[73] Assignee: The United States of America as represented by the Secretary of the Air Force, Washington, D.C.

[21] Appl. No.: 435,636

[22] Filed: Nov. 13, 1989

[51] Int. Cl.[5] ..... C06G 33/08

[52] U.S. Cl. ..... 149/38; 149/41; 149/47; 149/62; 149/76; 149/88

[58] Field of Search ..... 149/38, 41, 47, 62, 149/76, 88

[56] References Cited

U.S. PATENT DOCUMENTS

| | | | |
|---|---|---|---|
| 4,421,578 | 12/1983 | Voreck | 149/88 |
| 4,507,161 | 3/1985 | Sujansky et al. | 149/21 |
| 4,552,597 | 11/1985 | Abegg et al. | 149/88 |
| 4,600,452 | 7/1986 | Jessop et al. | 149/47 |
| 4,632,714 | 12/1986 | Abegg et al. | 149/88 |
| 4,701,227 | 10/1987 | Loverro | 149/47 |
| 4,747,892 | 5/1988 | Spencer | 149/88 |

*Primary Examiner*—Stephen J. Lechert, Jr.

*Attorney, Agent, or Firm*—Charles E. Bricker; Donald J. Singer

[57] ABSTRACT

A melt/cast explosive composition comprising about 20 to 100 wt. % of a binary complex of ammonium nitrate (AN) and methyl nitroguanidine (MeNQ) in a molar ratio of about 0.55:1 to 1.35:1. This binary complex may be used alone or it may be formulated with up to about 80 wt. % compatible fuels and/or oxidizers to tailor the formulation for specific military or commercial applications.

13 Claims, 1 Drawing Sheet

INTERMOLECULAR COMPLEX EXPLOSIVES

RIGHTS OF THE GOVERNMENT

The invention described herein may be manufactured and used by or for the Government of the United States for all governmental purposes without the payment of any royalty.

BACKGROUND OF THE INVENTION

This invention relates to explosives, particularly to explosive compositions based upon ammonium nitrate.

Traditional general-purpose explosives comprise trinitrotoluene (TNT), which has several disadvantages. It is a Class-A explosive, requiring special mixing and handling procedures and storage facilities, all accordingly increasing the cost of use. The preparation of this explosive is through nitrate substitution of toluene by a mixed acid consisting of concentrated nitric acid and sulphuric acid. The cost of concentrated nitric acid is moderately expensive and any excess nitric acid in the product destabilizes the explosive and presents corrosion problems. Trinitrotoluene is not water soluble and bomb disposal cannot be done economically by steam or hot water.

It is known to produce cast high explosive compositions by solidification of a molten mixture of ammonium nitrate (AN) and ethylenediamine dinitrate (EDDN). A binary mixture of ethylenediamine dinitrate and ammonium nitrate is water soluble, thereby having several advantages over trinitrotoluene such as safer storage as a non-explosive water solution and cheaper disposal. However, the binary mixture has a high melting point, has stability problems, and is expensive.

It is known to add potassium nitrate (KN) to the AN/EDDN mixture to improve its stability. The problems associated with the binary mixture remain and the amount of chloride impurities is increased by the additional chloride impurities found in potassium nitrate (KN). If these impurities are not removed, the explosive has serious corrosion problems. If the impurities are removed the cost of the explosive increases greatly. The present method of making the ternary mixture is to mix solid ethylenediamine dinitrate, ammonium nitrate and potassium nitrate. Ethylenediamine dinitrate is not commercially availabe in large quantities and is expensive. Industrial grade ammonium nitrate and potassium nitrate are too impure to be used without the additional expense of purification. Dry mixing three explosives to form an explosive mixture requires special procedures and precautions, causing the cost of the process to increase significantly.

Other explosives compositions based upon ammonium nitrate include AN/fuel oil, AN/TNT/RDX (cyclotrimethylenetrinitramine), AN/ammonium salt of a nitroazole/RDX, AN/EDDN/KN/NQ (nitroguanidine) and the like.

It is known that ammonium nitrate is a hazardous material to manufacture on an industrial scale, to handle in large amounts, and to store in great masses, especially for relatively long periods of time. It is also known that the shock sensitivity of ammonium nitrate increases seriously after exposure to a few temperature cycles through the 32.3° C. (90° F.) transition point. (Up to 32.3° C. the stable crystal form is orthorhombic bipyrimidal; from 32.3° C. to 84° C. the stable crystal form is orthorhombic).

Military explosive formulations have consisted primarily of eutectic mixtures of fuel-rich components such as EDDN, quanidinium nitrate or NQ with oxidizer-rich components such as AN, sodium nitrate, KN or calcium nitrate. Commercial compositions have consisted primarily of gels, slurries or aqueous emulsions of AN with various fuels and additives.

The high explosive eutectic formulations utilized for military applications have typically been plagued by problems relating to large critical diameters, performance variability as a response to particle size and fractional crystallization, and sensitivity to shock. The non-ideal behavior of composite explosive is believed to be a consequence of the relatively great distances, on the atomic and molecular scale, between the fuel-rich and oxidizer-rich components. These distances can exceed $10^5$ Angstroms between crystal centers. This is in contrast to mono-molecular (ideal) explosive in which reacting atoms are separated by less than $10^1$ Angstroms.

It is well known that improvements in explosive properties, such as performance and critical diameter, can be achieved through greater fuel oxidizer intimacy. Traditional methods for attaining this increased intimacy have relied on reducing particle size through the use of exact eutectic formulations or emulsification.

Accordingly, it is an object of this invention to provide a novel explosive composition based upon ammonium nitrate.

Other objects and advantages of the present invention will be apparent to those skilled in the art from a reading of the following description of the invention.

SUMMARY OF THE INVENTION

In accordance with the present invention there is provided a melt/cast explosive composition comprising about 20 to 100 wt. % of a binary complex of ammonium nitrate (AN) and methynitroguanidine (MeNQ) in a molar ratio of about 0.55:1 to 1.35:1. This binary complex may be used alone or it may be formulated with up to about 80 wt. % compatible fuels and/or oxidizers to tailor the formulation for specific military or commercial applications.

DESCRIPTION OF THE DRAWING

In the drawing Referring to FIG. 1, it can be seen that as the mole fraction of AN (MFa) is varied from 0.0 to 1.0, eutectic points are defined at MFa's of 0.3719 (116.9° C.) and 0.5678 (117.5° C.). The region between these eutectic points, labeled "COMPOUND", defines a binary complex between AN and MeNQ. It can also be seen that a 1:1 mixture of AN and MeNQ has a mdelting point of 118.4° C.

DETAILED DESCRIPTION OF THE INVENTION

Figure 1:
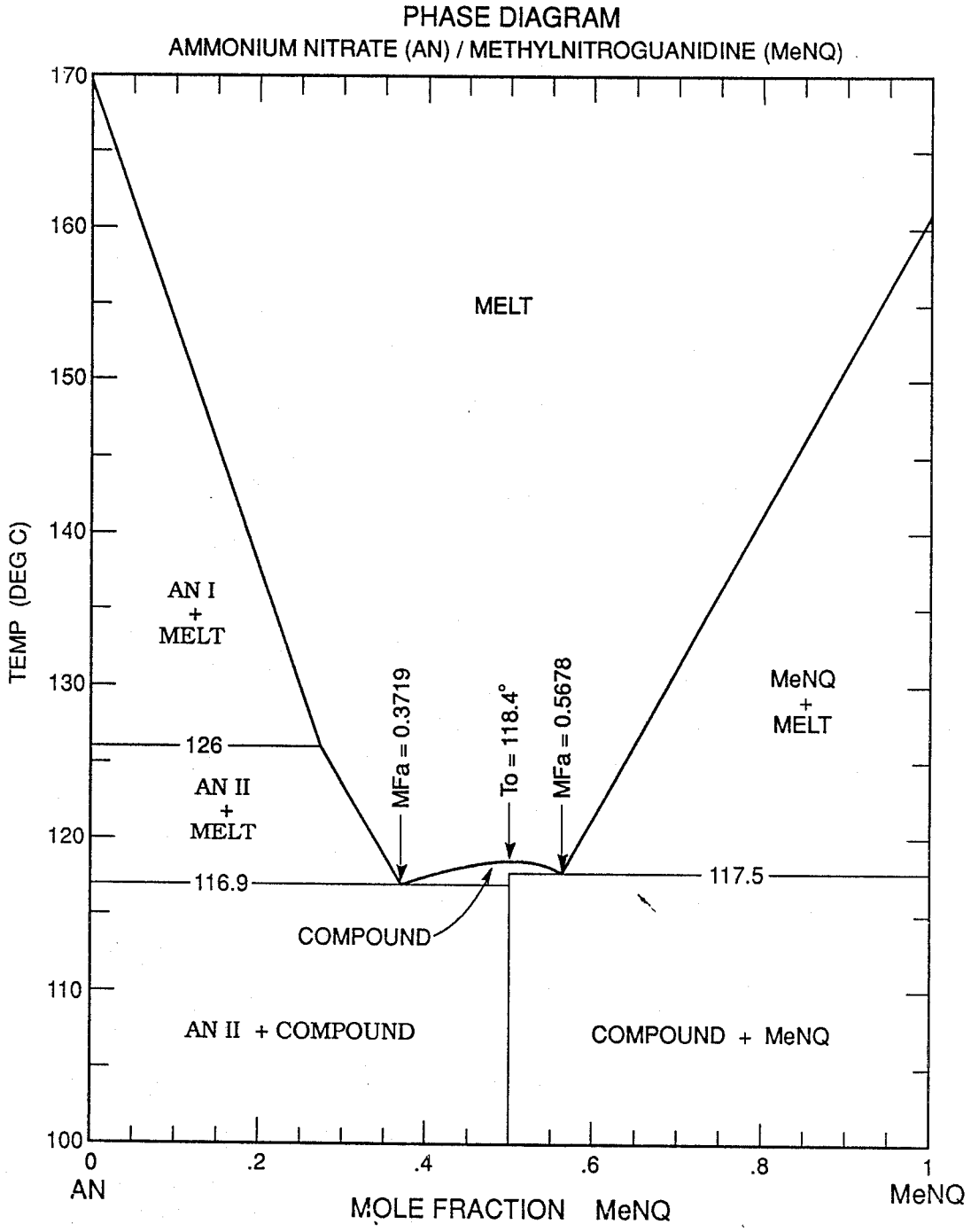
FIG. 1 is a temperature-composition phase diagram for the two component system, ammonium nitrate (AN) and methylnitroguanidine (MeNQ).

Although the AN/MeNQ system may be used alone, to be compatible with existing melt/cast loading facilities it is necessary that the melt/cast explosive formulations have a melting point below 110° C., preferably below 100° C. The mdelting point can be reduced by the addition of a melting point depressant, such as, for example, nitroguanidine, guanidine nitrate, aminoquanidine nitrate, urea, potassium nitrate, sodium nitrate, lithium nitrate, calcium nitrate, ammonium perchlorate, and the like. The amount of such depressant can range from about 0.1 to about 25 wt. %.

The explosive composition may contain up to about 80 wt. % of at least one other fuel-rich or oxidizer-rich component such as, for example, nitroguanidine (NQ), RDX, HMX, PETN, ammonium perchlorate, aluminum powder, and the like. Certain of these compounds are also listed in the list of melting point depressants, above. Accordingly, the combined quantity of depressant and fuel-rich or oxidizer-rich component should not exceed about 80 wt. % of the melt/cast composition.

The explosive compositions of this invention can be prepared by heating a mixture of the components, with stirring. When a high explosive, such as NQ, RDX, HMX, or PETN it to be incorporated, it is preferable to prepare a melt comprising AN, MeNQ and, optionally, one or more melting point depressants, and add the high explosive to the melt. The explosive composition can be flaked, using a chiller belt, or cast into molds.

The following example illustrates the invention:

EXAMPLE

Composition I was prepared by melting and mixing 39.2 parts AN, 45 parts MeNQ (Aldrich Chemical Co., Milwaukee, Wis.), 11.3 parts NQ and 4.5 parts sodium nitrate at 105°-110° C. After melting, 20 inches Hg vacuum was applied for 15 minutes to remove water and trapped air. The mixture was cast at 95°-100° C. and cooled slowly.

Composition II was similarly prepared using 40 parts Composition I and 60 parts high bulk density nitroguandidine.

Composition III was similarly prepared using 30 parts of Composition I, 20 parts 5-10 micron aluminum powder and 50 parts high bulk density nitroguanidine.

The properties of these compositions are given in the Table below in comparison to the properties of Tritonal (80% TNT/20% Al), EAK (46% EDDN/46% AN/8% KN) and PBX 9502 (95% triaminotrinitrobenzene/5% Kel-F binder):

TABLE

| Formulation | 50% Impact Sensitivity 5 Kg wt | Density | Detonation Velocity (km/sec) | Initiation Pressure (kbar) |
|---|---|---|---|---|
| Tritonal | 70 | 1.72 | 6.6 | 10 |
| EAK | 20 | 1.63 | 7.6 | 14 |
| PBX 9502 | >200 | 1.89 | 7.5 | 70 |
| I | 88 | 1.52 | 7.4 | 35 |
| II | 112 | 1.63 | 7.6 | 50 |
| III | 143 | 1.72 | 7.4 | 85 |

A series of compositions were prepared to illustrate the effects of various melting point depressants. The recipes are given below:

| Composition IV (melt point 104° C.): | |
|---|---|
| MeNQ | 42.4 |
| AN | 36.9 |
| NQ | 10.5 |
| KN | 5.9 |
| $NaNO_3$ | 4.3 |

| Composition V (melt point 101° C.): | |
|---|---|
| MeNQ | 31.3 |
| AN | 45.0 |

-continued

| Composition V (melt point 101° C.): | |
|---|---|
| Guanidinium nitrate | 23.7 |

| Composition VI (melt point 100° C.): | |
|---|---|
| MeNQ | 43.5 |
| AN | 36.0 |
| NQ | 10.5 |
| $NH_4ClO_4$ | 10.0 |

Various modifications may be made to the invention as described without departing from the spirit of the invention or the scope of the appended claims.

We claim:

1. A melt/cast explosive composition comprising about 20 to 100 wt. % of a binary complex of ammonium nitrate and methylnitroguanidine in a molar ratio of about 0.55:1 to 1.35:1.

2. The explosive composition of claim 1 containing about 0.1 to about 25 wt. % of at least one melting point depressant.

3. The explosive composition of claim 2 wherein said melting point depressant is selected from the group consisting of nitroguanidine, guanidine nitrate, aminoguanidine nitrate, urea, potassium nitrate, sodium nitrate, lithium nitrate, calcium nitrate and ammonium perchlorate.

4. The explosive composition of claim 1 containing up to about 80 wt. % of at least one other fuel-rich or oxidizer-rich component.

5. The explosive composition of claim 4 wherein said other component is selected from the group consisting of nitroguanidine, RDX, HMX, PETN, ammonium perchlorate and aluminum powder.

6. The explosive composition of claim 1 containing about 0.1 to 80 wt. % of at least one melting point depressant and at least one other fuel-rich or oxidizer-rich component.

7. The explosive composition of claim 6 wherein said melting point depressant is selected from the group consiting of nitroguanidine, guanidine nitrate, aminoguanidine nitrate, urea, potassium nitrate, sodium nitrate, lithium nitrate, calcium nitrate and ammonium perchlorate, and wherein said other component is selected from the group consisting of nitroguanidine, RDX, HMX, PETN, ammonium perchlorate and aluminum powder.

8. The explosive composition of claim 7 containing 39. 2 parts ammonium nitrate, 45 parts methylnitroguanidine, 11.3 parts nitroguanidine and 4.5 parts sodium nitrate.

9. The explosive composition of claim 8 containing 40 parts of the composition of claim 8 and 60 parts nitroguanidine.

10. The explosive composition of claim 8 containing 30 parts of the composition of claim 8, 20 parts aluminum powder and 50 parts nitroguanidine.

11. The explosive composition of claim 7 containing 36.9 parts ammonium nitrate, 42.4 parts methylnitroguanidine, 10.5 parts nitroguanidine, 5.9 parts potassium nitrate and 4.3 parts sodium nitrate.

12. The explosive composition of claim 7 containing 36.0 parts ammonium nitrate, 43.5 parts methylnitroguanidine, 10.5 parts nitroguanidine and 4.3 parts ammonium perchlorate.

13. The explosive composition of claim 7 containing 45.0 parts ammonium nitrate, 31.3 parts methylnitroguanidine and 23.7 parts guanidinium nitrate.

* * * * *

UNITED STATES PATENT AND TRADEMARK OFFICE

CERTIFICATE OF CORRECTION

PATENT NO. : 4,948,438

DATED : August 14, 1990

INVENTOR(S) : Michael A. Patrick et al

It is certified that error appears in the above-identified patent and that said Letters Patent is hereby corrected as shown below:

Col 2, line 38, "methynitroguanidine" should read ---methylnitroguanidine---.

Col 2, line 64, "mdelting" should read ---melting---.

Col 2, lines 66-67, "aminoquanidine" should read ---aminoguanidine---.

Col 3, lines 32-33, "nitroguandidine" should read ---nitroguanidine---.

Signed and Sealed this

Twenty-first Day of January, 1992

*Attest:*

HARRY F. MANBECK, JR.

*Attesting Officer*

*Commissioner of Patents and Trademarks*